US005600203A

United States Patent [19]

Namikawa et al.

[11] Patent Number: 5,600,203

[45] Date of Patent: Feb. 4, 1997

[54] AIRTIGHT ENVELOPE FOR IMAGE DISPLAY PANEL, IMAGE DISPLAY PANEL AND METHOD FOR PRODUCING SAME

[75] Inventors: Mamoru Namikawa; Tatsuo Yamaura; Yukio Ogawa; Yoshio Makita; Satoshi Yoshimura; Yuichi Kogure, all of Mobara, Japan

[73] Assignee: Futaba Denshi Kogyo Kabushiki Kaisha, Mobara, Japan

[21] Appl. No.: 233,303

[22] Filed: Apr. 26, 1994

[30] Foreign Application Priority Data

Apr. 26, 1993 [JP] Japan ..... 5-099766
Nov. 22, 1993 [JP] Japan ..... 5-313971

[51] Int. Cl.[6] ..... H01J 29/50

[52] U.S. Cl. ..... 313/495; 313/422; 313/634; 313/292

[58] Field of Search ..... 313/495, 422, 313/496, 497, 634, 292; 156/89

[56] References Cited

U.S. PATENT DOCUMENTS 4,037,930 7/1977 Matsuyama ..... 359/80
4,252,414 2/1981 Kinugawa et al. ..... 359/75
4,745,332 5/1988 Ticher ..... 313/495
4,841,194 6/1989 Kishino et al. ..... 313/496
5,032,761 7/1991 Itoh et al. ..... 313/495
5,157,304 10/1992 Kane et al. ..... 313/495
5,207,607 5/1993 Nagano et al. ..... 313/634
5,277,946 1/1994 Nagai et al. ..... 428/426

*Primary Examiner*—Sandra L. O'Shea
*Assistant Examiner*—Vip Patel
*Attorney, Agent, or Firm*—Oblon, Spivak, McClelland, Maier & Neustadt, P.C.

[57] ABSTRACT

An airtight envelope for an FED capable of ensuring formation of a gap or internal space therein with high accuracy and preventing leakage thereof and a decrease in display area. An anode substrate having a phosphor-deposited display pattern formed thereon and a cathode substrate having an electron emission source formed thereon are sealed joined to each other using a sealing material, to thereby provide an airtight envelope for an FED. The substrates are provided at a portion thereof joined together with particulate or bar-like elements which are kept unmelted or substantially unsoftened. Also, spacers are arranged at positions in a gap between the anode substrate and the cathode substrate which do not interfere with a display by the FED.

6 Claims, 9 Drawing Sheets

FIG. 12B
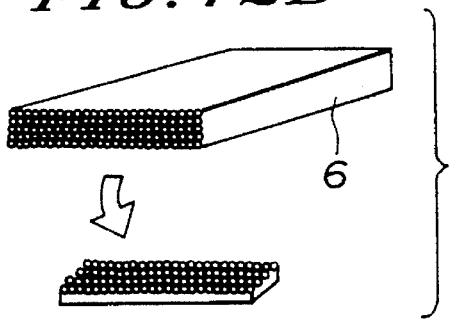
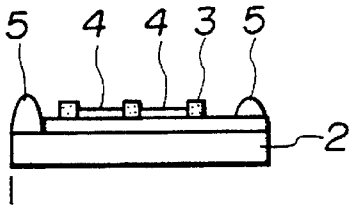
FIG. 12A
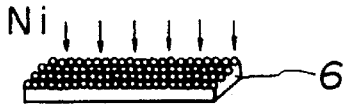
FIG. 12C
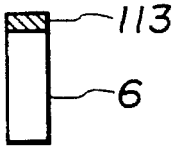
FIG. 12D
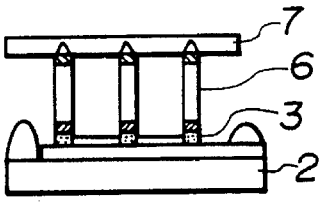
FIG. 12G
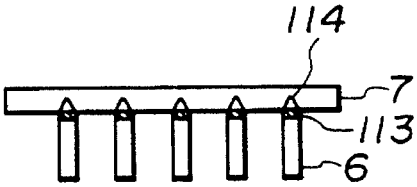
FIG. 12E
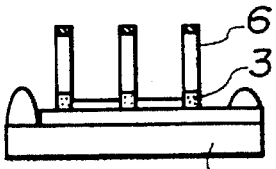
FIG. 12H
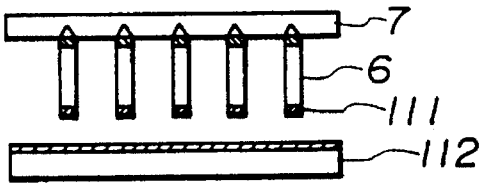
FIG. 12F

AIRTIGHT ENVELOPE FOR IMAGE DISPLAY PANEL, IMAGE DISPLAY PANEL AND METHOD FOR PRODUCING SAME

BACKGROUND OF THE INVENTION

1. Field of the Invention

This invention relates to an airtight envelope for an image display panel, and an image display panel and a method for producing the image display panel; and more particularly to an airtight envelope for an image display panel formed into an airtight structure by sealedly joining an anode substrate and a cathode substrate to each other by means of a sealing material mainly consisting of frit glass, and an image display panel including a field emission type cathode acting as an electron source and a method for producing the image display panel.

2. Discussion of the Background

A fluorescent display panel which has been conventionally known as one of display panels in the art is generally constructed into an airtight structure by sealedly joining upper and lower substrates to each other. More particularly, such a fluorescent display panel is so formed that two glass plates serving as upper and lower substrates are arranged so as to be opposite to each other and a glass bar of a rectangular shape in section acting as side plates is arranged in a frame-like manner between the glass plates so as to be positioned at a periphery thereof. Then, the glass plates and glass bar are weldedly sealedly joined to each other by means of a sealing material mainly consisting of frit glass comprising low-melting glass, resulting in an airtight envelope structure being provided.

Now, such an airtight envelope structure will be described hereinafter with reference to FIG. 8.

In FIG. 8, reference numerals 40 and 41 designate an anode substrate and a glass cover, which are arranged so as to serve as an upper substrate and a lower substrate, respectively. The substrates each are formed into a thickness sufficient to permit the airtight envelope to bear an atmospheric pressure. More particularly, they are formed into a thickness of 1.3 to 3.5 mm depending on a size of the package. In particular, when the fluorescent display panel is of the graphic type, the substrates are formed into a thickness of about 5 mm in the case that the panel is not constructed so as to facilitate formation and arrangement of spacers in a display area thereof.

The anode substrate 40 is provided on an inner surface thereof with a display pattern 42 formed of phosphors. Reference numerals 43 and 44 designate a grid electrode and a filamentary cathode (hereinafter referred to as "filament"), respectively.

A gap or space defined between the anode substrate 40 and the glass cover 41 in which the grid electrode and filament 44 are arranged is evacuated to a vacuum. For this purpose, a procedure is employed which comprises the steps of forming the display pattern 42 on the anode substrate 40 by patterning of phosphors, arranging the grid electrode 43 and filament 44 above the abode substrate 40, disposing side glass plates 45 on a periphery of the anode substrate 40 and then sealedly mounting the glass cover 41 through the side plates 45 on the anode substrate 40 as shown in FIG. 8.

The sealed joining is carried out by interposedly arranging a low-melting sealing material 46 such as powdered glass between each of the side glass plates 45 and each of the upper and lower substrates 40 and 41 and heating it to a temperature of about 500° C. This causes the sealing material 46 to be melted to sealedly join the anode substrate 40 and glass cover 41 to each other, resulting in a sealed airtight envelope being formed. Then, the airtight envelope thus formed is evacuated to a vacuum.

There is also known another display panel in the form of a field emission display (hereinafter also referred to as "FED"), in which a gap between an anode and a cathode is formed into a dimension as small as, for example, 200 μm. Thus, when the FED, as shown in FIG. 9, is to be constructed in such a manner that side glass plates 55 arranged in a frame-like manner are fixed to upper and lower substrates 50 and 51 by means of a sealing material 56 as in the fluorescent display panel described above, it is required to form the side glass plates 55 defining a gap between the substrates 50 and 51 into a thickness as small as about 180 μm. Unfortunately, it is substantially impossible to execute such formation. Also, this requires that a layer of the sealing material is formed into a reduced thickness; therefore, air bubbles which are possibly formed in the sealing material layer cause airtightness in the envelope to be deteriorated.

To the problem described above, such an approach as shown in FIG. 10 is proposed. In the approach, the side glass plates 55 are arranged on an inner periphery of the sealing material layer 56. Unfortunately, the approach causes a portion of the FED in which the side glass plates 55 are arranged to be excluded from a display area, resulting in the display area being significantly reduced.

Also, in order to permit the FED to bear an atmospheric pressure, the substrates 50 and 51 are formed into an increased thickness. However, formation of the substrates into a thickness as large as about 5 mm causes the FED to be highly increased in weight as compared with other display panels such as a liquid crystal display panel and the like.

In a conventional image display panel (hereinafter also referred to as "FED") which includes an airtight envelope and a field emission cathode (hereinafter also referred to as "FEC") acting as an electron source, various ways are employed to arrange support members between an anode substrate on which a display section is provided and a cathode substrate on which a cathode is provided to keep a gap between the anode substrate and the cathode substrate substantially constant.

A first way is to laminatedly arrange frit glass. More particularly, screen-printing of a paste containing frit glass and calcination of the paste is repeated to form laminated frit glass, resulting in the support member being provided. Alternatively, a plurality of paste layers formed in turn by printing may be calcined in a lump. Also, the support member may be formed by printing a photosensitive glass paste on at least one of the substrates, forming it into a predetermined shape by photolithography and then calcining it.

A second way is to use photosensitive resin. More particularly, heat-resistant photosensitive resin such as polyimide or the like is deposited on at least one of the substrates by spraying or the like and subject to masked exposure, followed by development, leading to provision of the support member of a desired shape.

Unfortunately, the ways described above exhibit disadvantages when a graphic display exhibiting resolution as high as CRT is to be provided by the FED.

In general, it is required to arrange the support members while minimizing deterioration in efficiency with which the FED is evacuated and minimizing generation of residual gas in the FED. Also, when, for example, phosphor layers of luminous colors R, G and B which have a width of 100 μm are to be arranged at pitches of 0.36 mm in the display section of the FED, it is required to set a surface of each of the support members contacted with the substrate at a width as small as 50 μm or less in order to restrain the support member from interfering with displaying by the FED. However, in view of dielectric strength between the cathode and the anode and spreading of electrons emitted from the cathode, it is required to form each of the support members into a height as large as 0.1 to 0.3 mm. Also, an arrangement of each of the support members is limited to a position between picture cells.

Now, disadvantages of the first and second ways described above will be described hereinafter.

The first way described above has a disadvantage of causing frit glass formed by printing to be restricted to a height or thickness as small as tens um. More particularly, in order to form the support member into a desired height, it is required to repeat printing for lamination of frit glass. Also, a configuration of the support member which is increased in height as compared with a width thereof renders formation of the support member by lamination of frit glass troublesome. Further, formation of the support member by lamination of frit glass fails to provide the support member with a desired configuration and provide satisfactory positional accuracy.

Also, the first way requires calcination of the paste, so that sagging occurs on an upper surface of the support member to render formation of the support member into a uniform height difficult. Thus, some of the support members in the FED fail to function to support the substrates, leading to deterioration in pressure resistance of the FED. Further, calcination causes vehicle contained in frit glass to be discharged in the form of gas from the support member, so that roughness is produced on a surface of the support member. Also, the roughness causes residual gas to adhere to the support member.

In the second way described above, a film formed by spraying is limited to a thickness as small as 100 μm. Therefore, when it is desired to form the support member into a height exceeding 100 μm, spraying must be repeated. Also, it causes emission of gas because of using an organic material.

In addition, use of the photosensitive glass paste in the first way and that of the photosensitive resin in the second way require formation of phosphor layers on the anode conductor subsequent to formation of the support members on the substrates. Unfortunately, formation of the phosphor layers is highly troublesome because it must be separately carried out for every phosphor.

SUMMARY OF THE INVENTION

The present invention has been made in view of the foregoing disadvantages of the prior art.

Accordingly, it is an object of the present invention to provide an airtight envelope for a display panel which is capable of accomplishing formation of a gap between an upper substrate and a lower substrate with high accuracy.

It is another object of the present invention to provide an airtight envelope for a display panel which is capable of effectively preventing a display area from being reduced.

It is a further object of the present invention to provide an image display panel which is capable of exhibiting uniform luminance and satisfactory pressure resistance.

It is still another object of the present invention to provide an image display device which is capable of permitting support members to be arranged while keeping a height of the support members uniform and minimizing adsorption of residual gas thereon.

It is still another object of the present invention to provide a method for producing an image display panel which is capable of providing an image display panel exhibiting such characteristics as described above.

In accordance with one aspect of the present invention, an airtight envelope for a display panel is provided. The airtight envelope includes an anode substrate and a cathode substrate. The anode substrate and cathode substrate are sealedly joined to each other by means of a sealing material mainly consisting of frit glass to provide an airtight structure. The airtight envelope also includes elements selected from the group consisting of particulate elements and bar-like elements. The elements are arranged at positions at which sealed joining between the anode substrate and the cathode substrate is carried out by means of the sealing material. The elements are formed of a material which is kept non-melted or substantially non-softened at a sealing temperature at which the sealed joining is carried out using the sealing material.

In a preferred embodiment of the present invention, the airtight envelope also includes spacers provided in a display area defined in a gap between the anode substrate and the cathode substrate. The spacers are arranged at predetermined positions in the display area which do not prevent displaying by the display panel. The spacers are softened at the sealing temperature, resulting in being fixed on the anode substrate and cathode substrate.

Particulate elements such as glass beads or bar-like elements such as glass fibers can be produced with high accuracy even when they have a diameter as small as, for example, 180 μm. Thus, incorporation of such particulate or bar-like elements in the sealing material permits them to function as spacers while preventing a decrease in display area.

Also, in a preferred embodiment of the present invention, spacers may be arranged so as to function as support members at predetermined positions in the display areas between both substrates. Such a construction permits the substrates having a thickness as large as about 1 mm to be used for construction of the vacuum envelope.

In accordance with another aspect of the present invention, an image display panel is provided. The image display panel includes an anode substrate provided thereon with a display section including phosphors and a cathode substrate provided with a field emission type electron source on an inner surface thereof facing the display section of the anode substrate. The anode substrate and cathode substrate are sealedly joined at an outer periphery thereof to each other by means of a sealing material so as to be spaced from each other at a predetermined interval therebetween. The panel also includes support members arranged at positions between the anode substrate and the cathode substrate at which the display section is not arranged. The support members each comprise a bar-like element.

In accordance with a further aspect of the present invention, a method for producing an image display panel is provided. The method comprises the steps of forming a bar-like material into support members of a predetermined length, providing a magnetic element on one end of each of the support members, holding the support members on a holding substrate provided at a predetermined position thereof with a magnet means, positioning and fixing the other end of each of the support members on one of the anode substrate on which a display section is formed and the cathode substrate on which a field emission type electron source is formed, positioning and fixing the one end of each of the support members on the other of the anode substrate and cathode substrate, sealedly joining the anode substrate and cathode substrate to each other by means of a sealing material to form an airtight envelope, and evacuating the airtight envelope to a vacuum.

In accordance with this aspect of the present invention, a method for producing an image display panel is provided. The method comprises the steps of sucking support members onto a positioning means provided with openings and a suction means communicating with the openings to position and hold one end of each of the support members in each of the openings, positioning and holding, on one of the anode substrate on which a display section is formed and the cathode substrate on which a field emission type electron source is formed, the other end of each of the support members held on the positioning means, positioning and fixing, on the other of the anode substrate and cathode substrate, the one end of each of the support members released from constraint by the positioning means, and sealedly joining the anode substrate and cathode substrate to each other by means of a sealing material to form an airtight envelope and evacuating the envelope to a vacuum.

In the present invention, the support members each comprise a bar-like element, so that it is possible to form the support member into a uniform height and substantially increase the height as compared with a width or diameter thereof. This permits a gap between the anode substrate and the cathode substrate to be kept constant without preventing displaying by the FED. Also, formation of the bar-like element into the support member renders a surface of the support member to be smooth, to thereby prevent gas to adhere to the surface of the support member.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 4(*b*) is a sectional view taken along line A—A of FIG. 4(*a*);

FIGS. 12 and 13 each are a flow chart showing steps in manufacturing of an image display panel according to the present invention.

DETAILED DESCRIPTION OF THE PREFERRED EMBODIMENTS

Now, the present invention will be described hereinafter with reference to the accompanying drawings.

Referring first to FIGS. 1 to 5, a first embodiment of an image display panel according to the present invention, which is embodied in the form of an FED panel.

Application of an electric field of about $10^9$ V/m to a surface of a metal or semiconductor material leads to a tunnel effect, to thereby cause electrons to pass through a barrier, resulting in emission of electrons being carried out in a vacuum even at a normal temperature. Such a phenomenon is called field emission and a cathode emitting electrons under such a principle is called an FEC (field emission cathode).

Figure 4A:
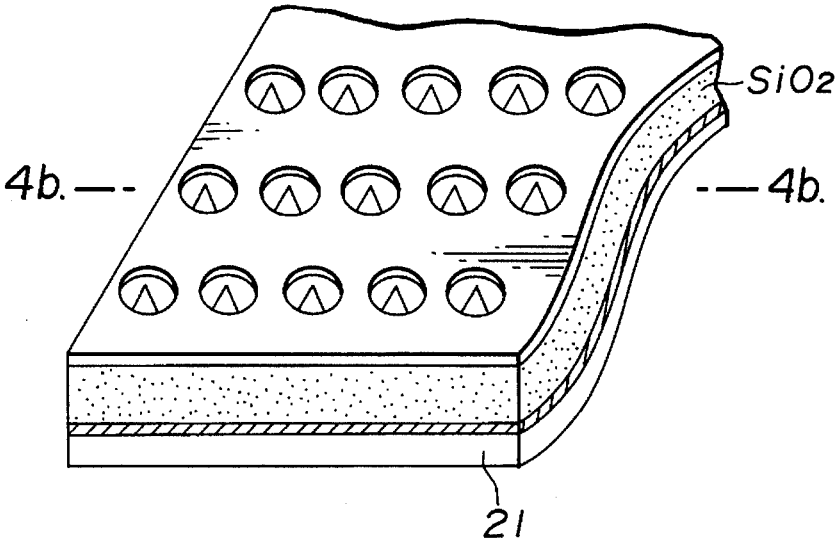
FIG. 4(*a*) is a perspective view showing an FEC block.
Figure 4B:
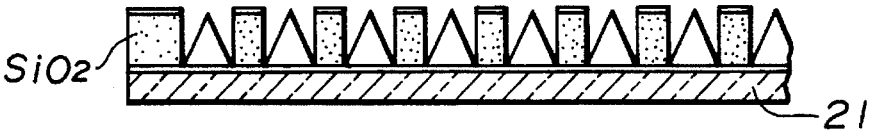

Recent semiconductor processing techniques permit a surface emission type FEC to be constructed of an array of FECs sized in microns. FIGS. 4(*a*) and 4(*b*) show a Spindt-type FEC which is an example of the surface emission type FEC, wherein FIG. 4(*a*) is a perspective view of the FEC prepared by semiconductor processing techniques and FIG. 4(*b*) is a sectional view taken along line A—A of FIG. 4(*a*).

The FEC shown in FIGS. 4(*a*) and 4(*b*) is so constructed that a substrate is provided thereon with a cathode electrode formed of a metal material such as aluminum or the like, which cathode electrode is formed thereon with emitters each formed into a cone-like shape. Also, the cathode electrode has provided thereon a gate electrode through a $SiO_2$ film. The emitters each are arranged in each of openings or through-holes formed through the gate electrode in such a manner that a distal end thereof is projected or exposed from each of the openings of the gate electrode.

The cone-like emitters may be arranged at pitches as small as 10 microns or less, so that it is possible to arrange tens of thousands to hundreds of thousands of FECs on a single substrate. Also, a distance between the gate electrode and the distal end of each of the cone-like emitters may be set to be as small as submicrons, so that a voltage as low as tens of volts may be applied between the gate electrode and the cathode electrode to permit electrons to be field-emitted from the emitter.

The FEC is formed into a shape like a flat plate as shown in FIG. 4(*a*), resulting in being a surface-emission type FEC; thus, it is possible to construct an FED of the surface-emission type FEC.

Figure 5:
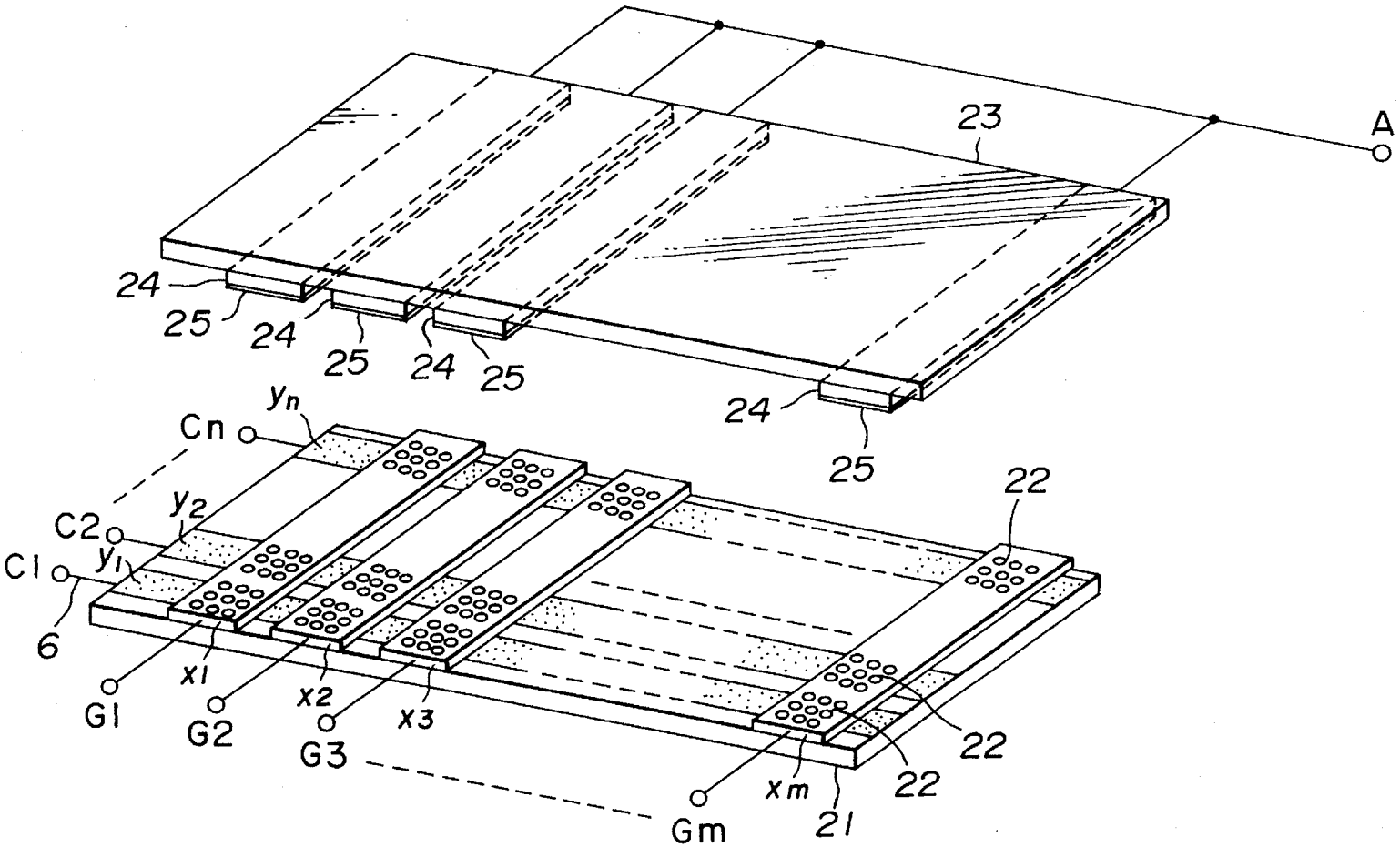
FIG. 5 is an exploded perspective view of the FED panel shown in FIG. 1.

FIG. 5 shows the thus constructed FED, wherein reference numeral 21 designates a first substrate, on which cathode electrodes $Y_l$ to $Y_n$ each are formed in a stripe-like manner so as to act as a Y electrode. To the cathode electrodes $y_l$ to $y_n$ are connected cathode terminals Cl to Cn, respectively, each of which is fed with a drive pulse.

Also, the FED includes gate electrodes $x_l$ to $x_m$ each acting as an X electrode, which are formed in a stripe-like manner on the cathode electrodes $y_l$ to $y_n$ through an insulator in a manner to be perpendicular to the cathode electrodes. The gate electrodes $x_l$ to $x_m$ have connected thereto gate terminals Gl to Gm, each of which is fed with a drive pulse. The cathode electrodes $y_l$ to $y_n$ (Y electrode) and gate electrodes $x_l$ to $x_m$ (X electrode) are arranged in a matrix-like manner.

The gate electrodes $x_l$ to $x_m$ each are formed with a plurality of holes 22, each of which acts to discharge therethrough electrons field-emitted from each of cone-like emitters (see FIG. 4) formed on the cathode electrodes. Each group of holes 22 positioned at each of intersections between the gate electrodes $x_l$ to $x_m$ and emitters corresponding thereto cooperate with each other to constitute each one FEC block, which forms one picture cell for an image to be displayed.

The FED also includes a second substrate 23 arranged so as to be opposite to the first substrate 21. The second substrate 23 is formed thereon with anode electrodes 24, which are arranged in a stripe-like manner so as to positionally correspond to the gate electrodes $x_l$ to $x_m$. The anode electrodes 24 each have connected thereto an anode drawing-out electrode A. The anode electrodes 24 each have provided on a surface thereof opposite to the gate electrodes $x_l$ to $x_m$ a phosphor 25, which is excited due to impingement of electrons thereon.

The parts or components described above are received in a sealed envelope, which is evacuated to a vacuum, resulting in providing the image display panel or FED.

An image display by the FED thus constructed is carried out by applying an anode voltage of a substantially constant level through the anode drawing-out electrodes A to the anode electrodes 24 formed on the second substrate 23. Also, the cathode terminals Cl to Cn each are fed with a scan pulse to scan each of the cathode electrodes $y_l$ to $y_n$ (Y electrode), so that the cathode electrodes arranged in the stripe-like manner are selected in turn, resulting in being driven.

Concurrently, the gate terminals Gl to Gm have applied thereto a voltage corresponding to data on an image signal depending on a timing at which the cathode electrodes $y_l$ to $y_n$ are scanned. This causes the picture cells of the phosphors 25 provided on the anode electrodes 24 to be excited by electrons emitted from the cathode electrodes $y_l$ to $y_n$ scanned. The picture cells are subject to luminous control depending on the voltage applied to the gate terminals Gl to Gm, resulting in one image plane of an image being displayed.

Figure 1:
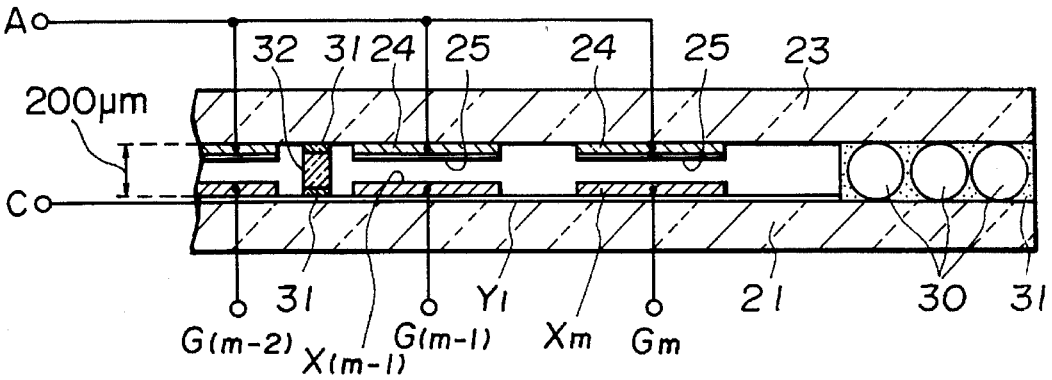
FIG. 1 is a fragmentary sectional view showing an embodiment of an image display panel according to the present invention.
Figure 2:
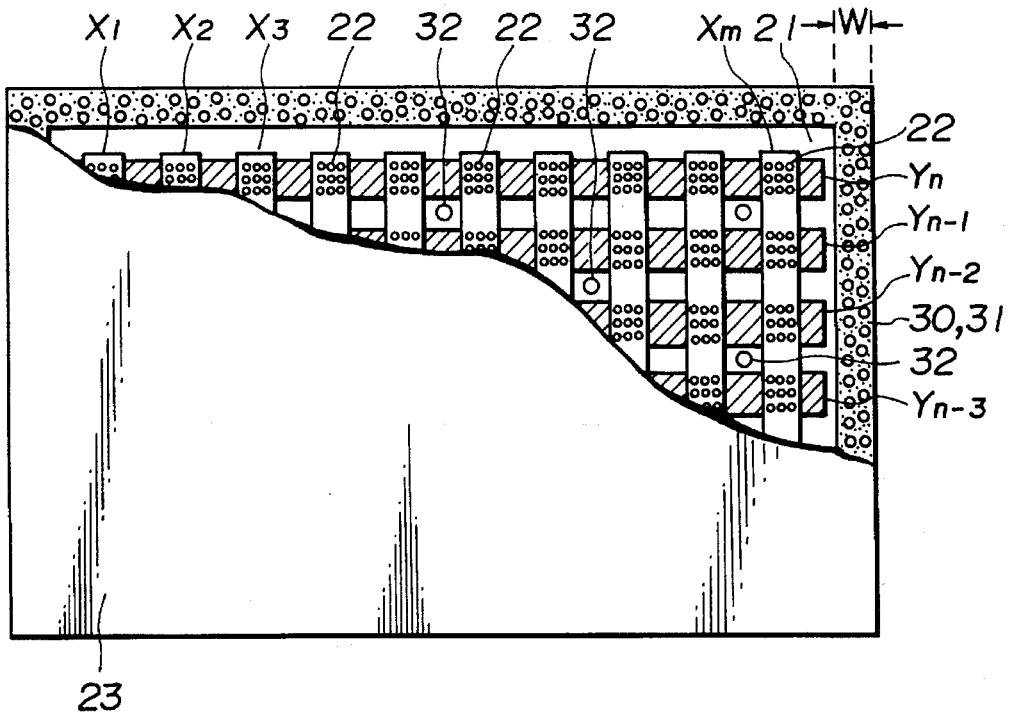
FIG. 2 is a plan view partly in section of the image display panel shown in FIG. 1.

In order to construct the FED as described above, the illustrated embodiment employs a spacer means and a sealing means as shown in FIGS. 1 and 2, wherein FIG. 1 is a fragmentary sectional view showing a part of the FED and FIG. 2 is a plan view schematically showing the first substrate 21 on which the cathode electrodes $y_l$ to $y_n$ and gate electrodes $x_l$ to $x_m$ are arranged.

In the FED, a gap between the anode and the cathode is set to be, for example, 200 μm as shown in FIG. 1.

In order to facilitate manufacturing of the FED while keeping the gap with high accuracy, the illustrated embodiment is so constructed that particulate elements comprising, for example, glass beads 30 of a diameter as small as 200 μm are incorporated in a layer of a sealing material 31 as shown in FIG. 1 when the first substrate 21 and second substrate 23 are sealedly joined to each other. The glass beads 30 each are formed of a glass material having a melting point higher than that of the sealing material 31 mainly consisting of frit glass, to thereby be prevented from being melted or substantially softened at a sealing temperature at which the substrates 21 and 23 are airtightly joined together by means of the sealing member 31 mainly consisting of frit glass (hereinafter referred to as "sealing temperature of sealing material").

Reference numeral 32 designates spacers formed of a glass fiber material into a height of about 205 to 210 μm. The spacers 32 each are arranged between the first substrate 21 and the second substrate 23 through a layer of the sealing material 31 mainly consisting of frit glass in a manner to be positioned at each of gaps between the phosphors patterned on the second substrate 23. Such an arrangement of the spacers 32 is carried out at predetermined intervals as shown in FIG. 2. FIG. 2 schematically shows the parts or components while disregarding a size of the components and pitches of arrangement thereof, therefore, it should be noted that the arrangement of the spacers is not necessarily carried out as shown in FIG. 2. Actually, the spacers may be arranged at pitches of about 2 mm in a horizontal direction. The spacers 32 may be made of a material which is softened at the sealing temperature of the sealing material 31 mainly consisting of frit glass.

Assembling of the image display panel of the illustrated embodiment is carried out by arranging the spacers 32 at predetermined positions on the first and second substrates 21 and 23 and forming, on a periphery of an inner surface of each of the substrates 21 and 23, the above-described layer of the sealing material 31 in which the glass beads 30 are incorporated, resulting in the panel being assembled as shown in FIG. 1.

Figure 3:
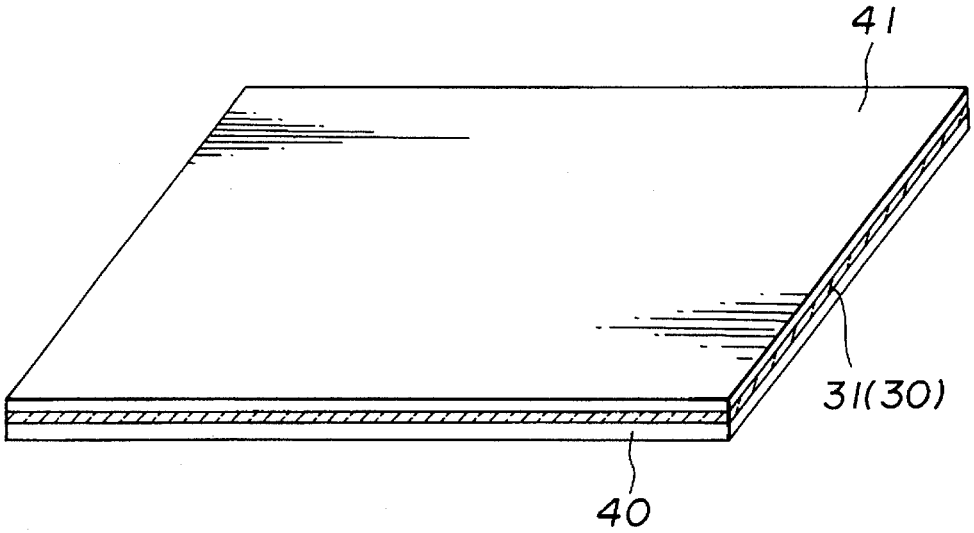
FIG. 3 is a perspective view of the image display panel shown in FIG. 1.

Then, the panel thus assembled is subject to heating at about 500° C. This causes the sealing material to be melted to sealedly join the substrates 21 and 23 to each other, resulting in the FED panel being formed as shown in FIG. 3. During the heating, the glass beads 30 are kept unmelted, to thereby set a distance of the gap between the substrates 21 and 23 with high accuracy. Also, the illustrated embodiment eliminates a necessity of arranging side glass plates independently from the sealing material 31, to thereby reduce the number of steps required for manufacturing of the panel.

The sealing material 31 mainly consisting of frit glass may be arranged in a frame-like configuration as shown in FIG. 2 and formed into a width W of about 2.5 to 3 mm. Such an arrangement and configuration of the sealing material 31 prevent deterioration in airtightness of the panel due to incorporation of the glass beads 30 in the sealing material 31.

A region of the panel which constitutes a display area is provided therein with the spacers 32, which are arranged at predetermined pitches in the display area and fixed between the substrates 21 and 23 by melting of the sealing material 31 during the above-described heating. However, the heating causes the spacers 32 to be softened. Thus, the spacers 32 each may be formed into a height increased by 5 to 10 μm as compared with a diameter of the glass beads 30. Such a formation of the spacers 32 into the height permits the glass beads 30 to keep the distance of the gap between the substrates with high accuracy, because the spacers 32 are compressed due to softening during the heating. Also, it permits the panel to uniformly bear an atmospheric pressure even when a height of the spacers 32 somewhat varies due to the compression. For example, a variation in height of the spacers 32 as large as about ±3% may be allowed.

Then, the substrates 21 and 23 thus sealedly joined is evacuated to a high vacuum, resulting in providing a vacuum or airtight envelope structure for the FED panel which includes the spacers arranged so as to permit the panel to uniformly bear an atmospheric pressure. Thus, such a construction of the illustrated embodiment permits the substrates 21 and 23 to be reduced in a thickness to a level as small as 1 mm, leading to down-sizing and weight-saving of the image display panel. Further, the above-described construction of the illustrated embodiment that the spacers 32 are arranged in the display area effectively prevents the display area from being reduced.

Figure 6:
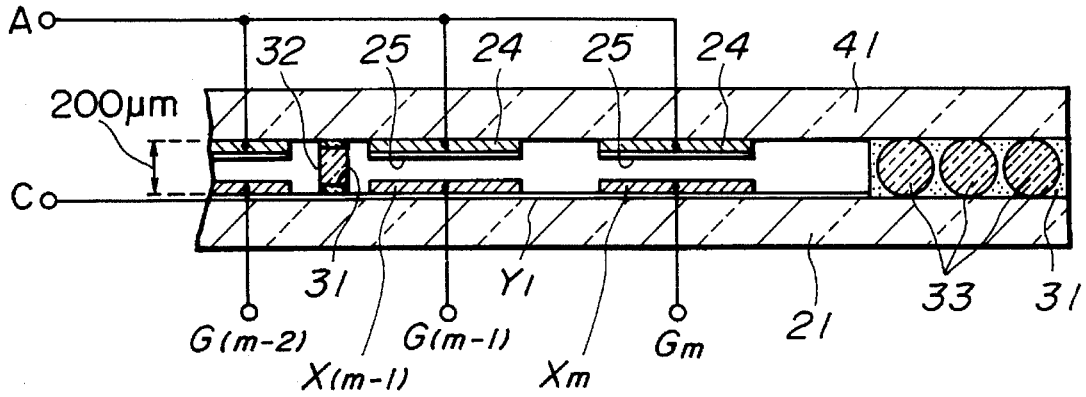
FIG. 6 is a fragmentary sectional view showing another embodiment of an image display panel according to the present invention.
Figure 7:
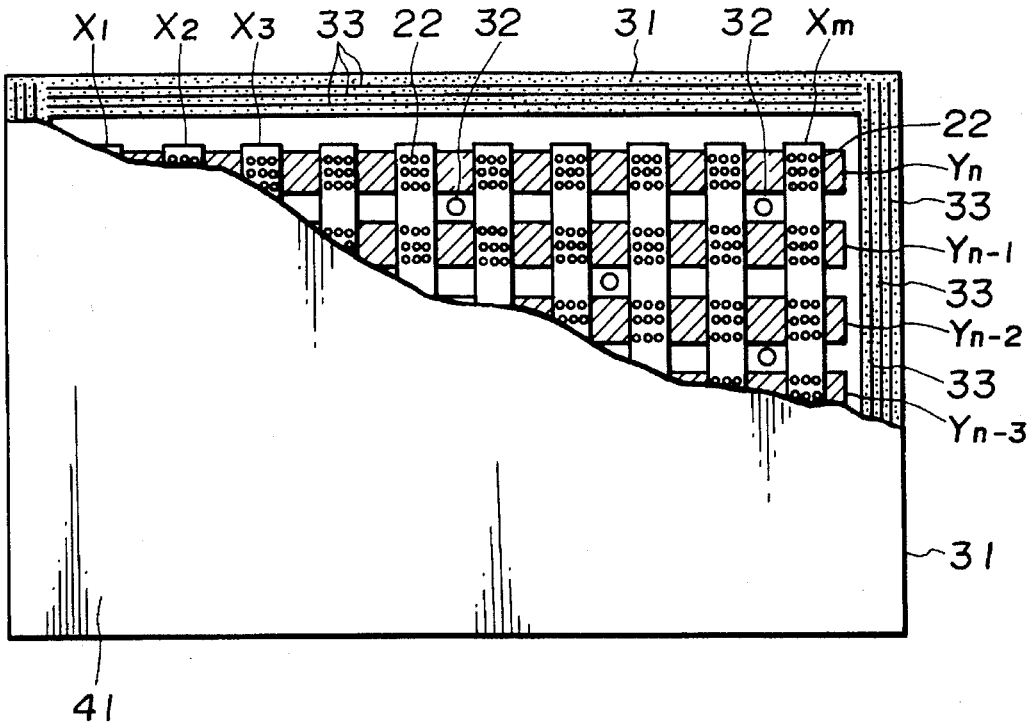
FIG. 7 is a plan view partly in section of the image display panel shown in FIG. 6.
Figure 8:
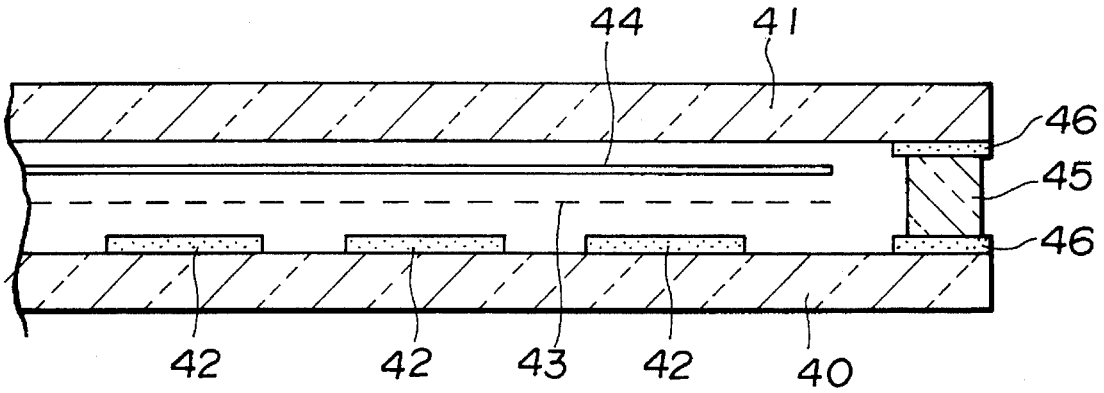
FIG.8 PRIOR ART
FIG. 8 is a fragmentary schematic sectional view showing a conventional fluorescent display panel.
Figure 9:
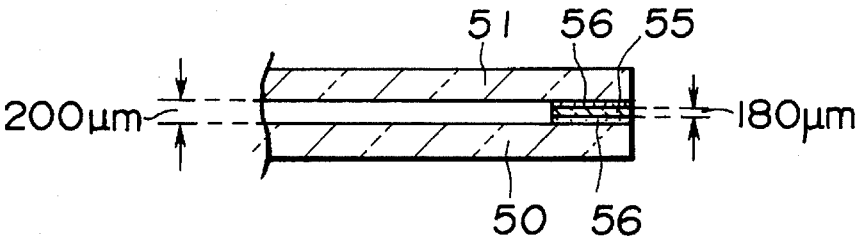
FIG.9 PRIOR ART
FIGS. 9 and 10 each are a fragmentary schematic sectional view showing a conventional FED panel.
Figure 10:
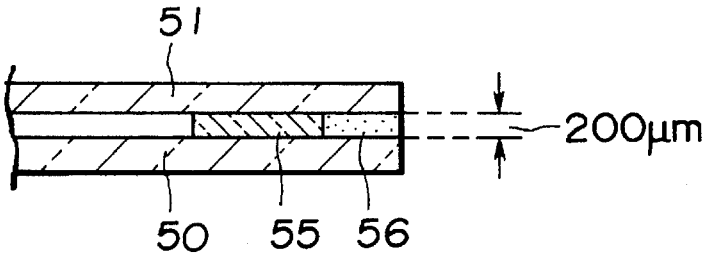
FIG.10 PRIOR ART

Referring now to FIGS. 6 and 7, a second embodiment of an image display panel or FED according to the present invention is illustrated.

An FED of the illustrated embodiment is constructed in substantially the same manner as the first embodiment except that a predetermined number of bar-like elements or glass fiber elements 33 cut into a predetermined length are arranged so as to extend along a periphery of the panel while being incorporated in a sealing material 31. More particularly, the display panel is heated while keeping the glass fiber elements 33 incorporated in a layer of the sealing material 31 mainly consisting of frit glass, so that the sealing material 31 is melted to join first and second substrates 21 and 23 to each other through the sealing material 31 and glass fiber elements 33. A distance of a gap defined between the first substrate 21 and the second substrate 23 is determined by a diameter of the glass fiber elements 33 which are kept unmelted during the heating.

Thus, it will be noted that the second embodiment exhibits the same functions and advantages as the first embodiment described above.

The second embodiment may be constructed in such a manner that spacers 32 are made of a material such as quartz or the like which is not softened at a sealing temperature of the sealing material 31 and the sealing material is formed into a thickness as large as about 5 to 10 μm. However, such a construction of the second embodiment may possibly cause a variation in height of the spacers 32 to lead to breakage or crushing of the sealing material 31, to thereby partly cover a phosphor pattern, resulting in being unsuitable for an image display panel of high definition.

Figure 11:
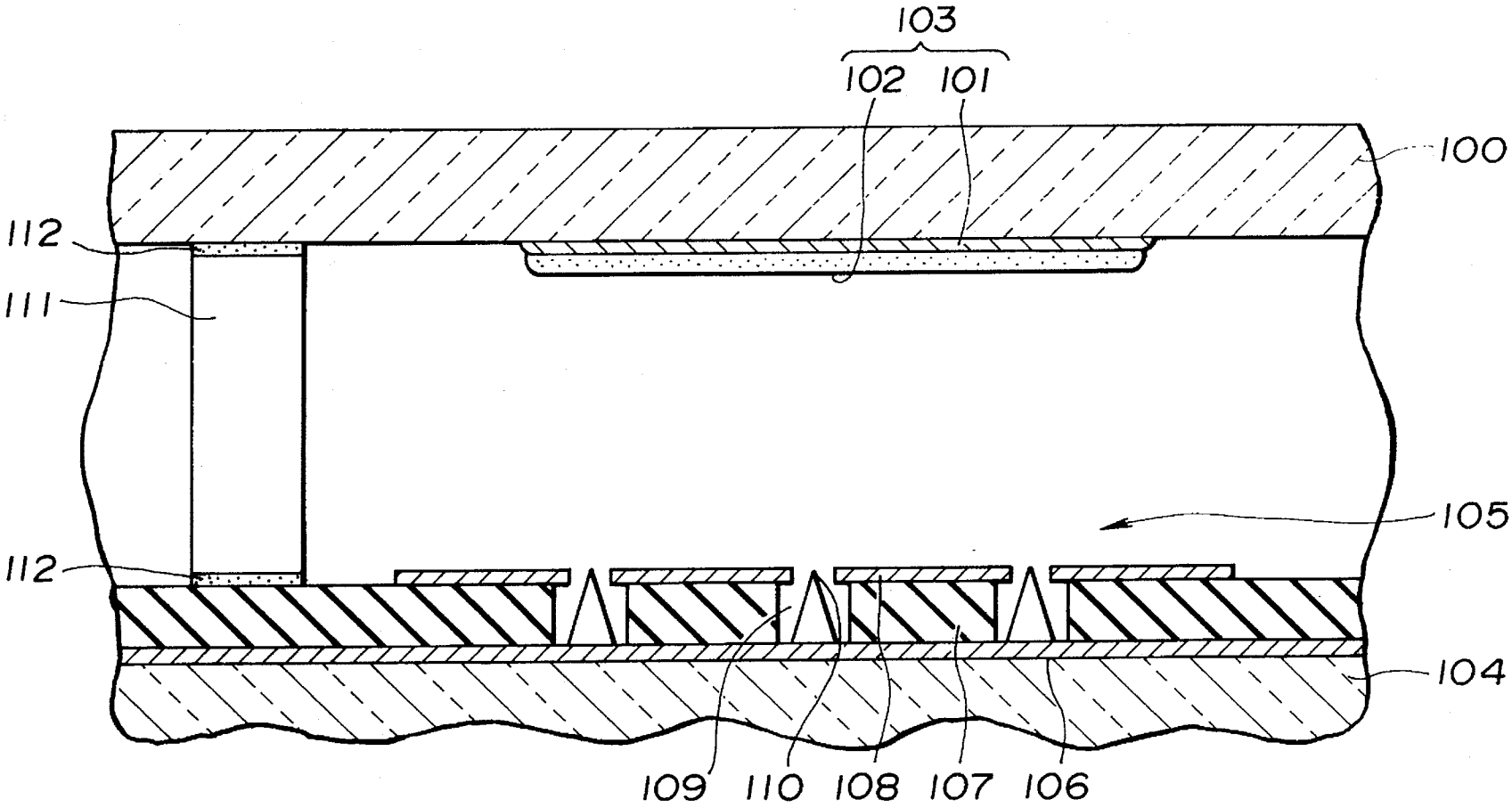
FIG. 11 is a fragmentary sectional view showing a further embodiment of an image display panel according to the present invention.
Figure 13A:
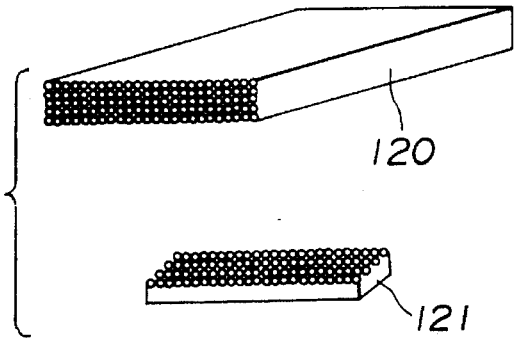
Figure 13D:
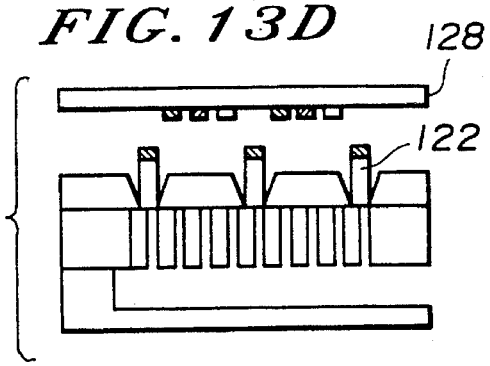
Figure 13B:
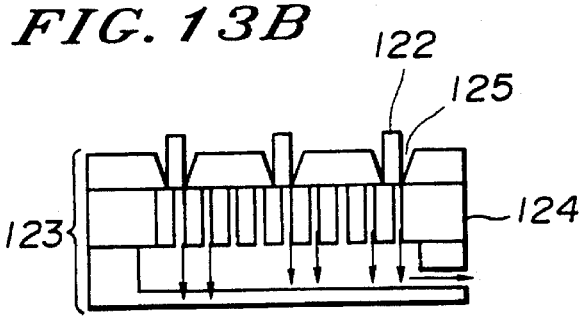
Figure 13E:
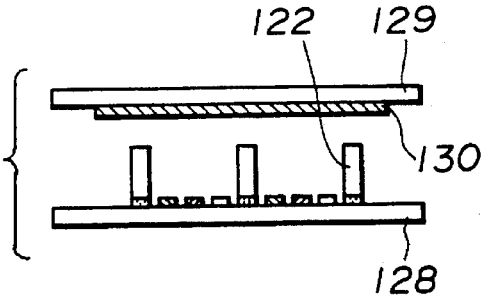
Figure 13C:
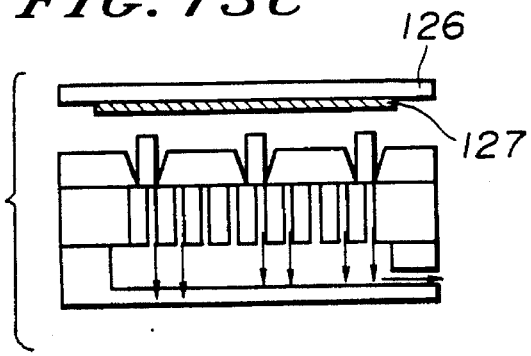
Figure 13F:
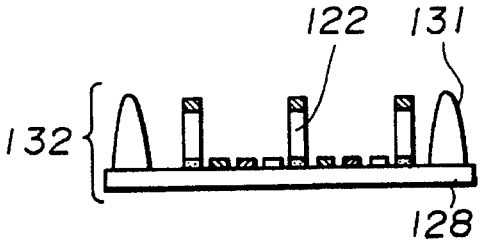

Referring now to FIGS. 11 to 13, a third embodiment of an image display panel according to the present invention and a method for producing the same will be described hereinafter.

FIG. 11 is a sectional view showing an image display device of the third embodiment. The image display panel includes a light-permeable and insulating anode substrate 100, which is provided on an inner surface thereof with light-permeable anode conductors 101 in a predetermined pattern. The anode conductors 101 each have a phosphor layer 102 deposited thereon, resulting in providing an anode acting as or constituting a display section.

The image display device also includes an insulating cathode substrate 104 arranged in a manner to be opposite to the anode substrate 100, which substrate 104 is provided on an inner surface thereof with FECs (field emission cathodes) 105 acting as an electron source. The FECs 105 each include a cathode conductor 106 arranged on the cathode substrate 104, a gate electrode 108 provided through an insulating layer 107 on the cathode conductor 106, and emitters 110 of a cone-like shape arranged on the cathode conductor 106 through holes 109 formed via the gate electrode 108 and insulating layer 107.

The image display device further includes support members 111 of a circular shape in cross section arranged between the anode substrate 100 and the cathode substrate 104. The support members 111 each may be in the form of a column-like member. The support members each may be formed by cutting a bar-like material such as, for example, a glass fiber material, into a predetermined length and arranged at a region of the image display device except the display section 103 and FEC 105. The support members 111 each are fixed at each of both ends thereof on the inner surface of each of the substrates 100 and 104 by low-softening glass 112. A plurality of such support members 111 are arranged for supporting the substrates 100 and 104, although only one support member 111 is shown in FIG. 11. Also, the anode substrate 100 and cathode substrate 104 are sealed at an outer periphery thereof with respect to each other by means of a sealing material (not shown).

Use of a glass fiber material for the support members 111 for the FED of the illustrated embodiment exhibits advantages.

More particularly, preparation of a glass fiber material of a predetermined width or diameter facilitates to provide the support member 111 of a predetermined height, because the height is provided by merely cutting the glass fiber material into a predetermined length. This permits the support member which has an increased height as compared with a width thereof to be readily provided. Use of such a support member permits an interval or gap between the anode substrate and the cathode substrate to be kept substantially constant, to thereby provide an FED which is free of a variation in luminance and exhibits satisfactory pressure resistance.

Also, the glass fiber material permits a width of the column or support member to be minimized while permitting the support member to bear an atmospheric pressure and providing the support member with a required height, resulting in the FED being provided with a sufficient display area and evacuation of the FED being carried out with high efficiency. Also, the glass fiber material permits the column or support member to be provided with a smooth or lubricous side surface, to thereby minimize adhesion of gas to the column member during production of the FED.

Now, incorporation or mounting of the glass fiber support members in the FED while keeping them in order will be described hereinafter.

First, a process utilizing a magnetic suction force will be described with reference to FIG. 12.

An anode substrate 2 is previously formed thereon with an anode conductor 1 made of a transparent conductive film or the like, a glass pattern 3 made of low-softening glass, and phosphors 4 of three colors R, G and B in predetermined pitches of, for example, 360 μm, as indicated at a step (1) in FIG. 12. Then, the anode substrate 2 has depositedly provided on a periphery thereof with a sealing glass paste 5.

Next, a step (2) shown in FIG. 12 is carried out. More particularly, thousands of glass fibers of 50 μm in diameter are bundled and bound resin. Then, the glass fiber bundle thus bound is sliced into a length of 200 μm, resulting in sliced glass fiber bundle pieces 6 being provided.

Thereafter, a Ni element 113 is formed on one end of each of the sliced glass fiber bundle pieces 6 by vacuum deposition, as indicated at a step (3) in FIG. 12.

Subsequently, the resin used for binding the glass fiber bundle is dissolved in an organic solvent, to thereby obtain the sliced glass fiber bundle pieces 6 to each of which the Ni element 113 is adhered and from each of which the resin is removed, as indicated at a step (4) in FIG. 12.

Then, as indicated at a step (5) in FIG. 12, a jig having magnetic elements 114 incorporated therein at predetermined pitches of arrangement of column members such as, for example, pitches of 360 μm is arranged on a glass substrate 7. Then, the glass substrate 7 is put on the glass fiber bundle pieces 6 while turning the magnetic elements 114 down, resulting in the glass fiber bundle pieces 6 being aligned at one end thereof with the magnetic elements 114 while turning the Ni elements 113 up.

Then, a step indicated at (6) in FIG. 12 is executed. More particularly, the glass fiber bundle pieces 6 each are contacted at the other end thereof with ultraviolet-curing adhesive 111 which contains an inorganic material and is previously deposited by a thickness of several microns on a glass substrate 112, so that the adhesive 111 is adhered to the other end of each of the glass fiber bundle pieces 6.

Subsequently, the glass fiber bundle pieces 6, as indicated at a step (7) in FIG. 12, are subject to ultraviolet-light irradiation while being kept aligned with the anode substrate 2 and put on the low-softening glass pattern 3 through the adhesive 111, to thereby cause the adhesive to be cured, followed by removal of the glass substrate 7, to thereby obtain an intermediate product or assembly.

Next, a step (8) shown in FIG. 12 is carried out. More particularly, the intermediate assembly described above is subject to calcination at a temperature of 400° to 500° C. to decompose the adhesive, so that the low-softening glass pattern 3 is softened while keeping the glass fiber bundle pieces 6 each acting as the support member put on the low-softening glass pattern 3 by means of the inorganic material contained in the adhesive and/or oxides thereof. Then, the intermediate assembly is cooled to cause the low-softening glass pattern 3 to be cured, leading to fixed mounting of the glass fiber bundle pieces 6 on the glass pattern 3. This results in the phosphor patterned substrate on which the support members of 50 μm in diameter are arranged at pitches of 360 μm being provided.

Then, the cathode substrate 104 on which the FECs 105 are formed as shown in FIG. 11 is mounted on the anode substrate while keeping low-softening glass deposited on the end of each of the glass fiber bundle pieces 6 on which the Ni element is formed, resulting in such an image display panel as shown in FIG. 11 being provided, which is then evacuated to a vacuum.

Thus, it will be noted that the above-described process of the present invention permits each of the glass fiber bundle pieces or support members to be positionally accurately mounted on the anode substrate or cathode substrate even when it is formed into an increased height as compared with a diameter thereof. It is a matter of course that the process of the present invention may be effectively applied to mounting or incorporation of glass fiber bundle pieces of a rectangular shape in section.

Now, incorporation or mounting of the glass fiber support members in the FED utilizing a suction force by evacuation will be described hereinafter with reference to FIG. 13.

First, a step (1) shown in FIG. 13 is executed. More particularly, thousands of glass fibers of 50 μm in diameter are bundled and bound with resin to prepare a glass fiber bundle 120. Then, the glass fiber bundle 120 thus bound is sliced into a length of 200 μm, resulting in sliced glass fiber bundle pieces 121 being provided. Next, the sliced glass fiber bundle pieces 121 each are immersed in an organic solvent to dissolve the resin, to provide a glass fiber element 122.

Then, a step (2) shown in FIG. 13 is executed using a positioning means 123 for positioning the glass fiber elements 122. The positioning means 123 includes a box-like base 124, which is constructed so as to communicate at an interior thereof with a pump (not shown) acting as a suction means. The base 124 is formed on an upper surface thereof with openings 125 in a manner to be arranged at pitches equal to those of an arrangement of the glass fiber elements 122 and communicate with the interior of the base 124. The openings 125 each are formed into a diameter slightly larger than a diameter of the glass fiber elements 122. Then, the glass fiber elements 122 are spread in a suitable amount on the upper surface of the base 124 while evacuating the base 124 by suction using the pump, resulting in the glass fiber elements 122 being suckedly held in the openings 125.

Then, a transfer paste 126 is uniformly applied to a glass plate 126 as indicated at a step (3) in FIG. 13. Then, the transfer paste 127 is surface-transferred to one end or a tip end of each of the glass fiber elements 122 held in the positioning means 123. The transfer paste 127 mainly consists of low-softening glass, to which resin and the like are incorporated as required, to thereby be provided with paste-like stickiness.

Next, the glass fiber elements 122 each having the transfer paste applied to the tip end thereof are transferred, by adhesion of the paste 127, to an anode substrate 128 on which anode conductors, phosphors and the like are previously arranged, as indicated at a step (4) in FIG. 13.

Subsequently, a step (5) in FIG. 13 is executed. In the step (5), a glass plate 129 which has a fixing paste 130 previously applied thereto in a uniform thickness is prepared. Then, the glass plate 129 arranged while keeping the fixing paste turned up is approached to the anode substrate 128 arranged while keeping the glass fiber elements 122 turned up, so that the fixing paste 130 is contacted with the other end of each of the glass fiber elements 122, to thereby be adhered thereto.

Thereafter, a sealing paste 131 is applied to a periphery of the anode substrate 128 as indicated at a step (6) in FIG. 13 and is then subject to calcination at a predetermined temperature to fixedly mount the glass fiber elements 122 on the anode substrate 128.

Then, the cathode substrate on which the FECs are formed is joined to the anode substrate 128 to provide the image display panel, which is then evacuated to a vacuum.

The openings 125 may be formed so as to be outwardly gradually increased in diameter or inwardly tapered, to thereby render a diameter of a bottom thereof slightly larger than that of the glass fiber elements 122. Such a configuration of the openings 125 facilitates holding of the glass fiber elements 122 in the openings 125 by suction.

In the method described above, mounting of the glass fiber elements 122 on the anode substrate 128 is carried out in the step separate from that in which mounting of the cathode substrate on the anode substrate is carried out. Alternatively, a combination formed by combining the cathode substrate with the glass elements 122 mounted on the anode substrate 128 may be subject to calcination.

In general, the prior art fails to vertically straight arrange column or support members each comprising a glass fiber element which is formed into an increased height because the glass fiber element is formed into a micro-width as small as tens μm. On the contrary, as will be noted from the above, the above-described process of the present invention facilitates incorporation of such support members in the FED.

Also, the process of the present invention permits the support members used to be formed into any desired shape such as a spherical shape like glass beads other than a column-like shape because the positioning means 123 facilitates positioning of such support members irrespective of their configuration. Also, in the process described above, the glass fiber element 122 acting as the support member is formed into a circular shape in section. Alternatively, it may be formed into a polygonal shape in section such as a triangular shape, a rectangular shape or the like.

Figure 14:
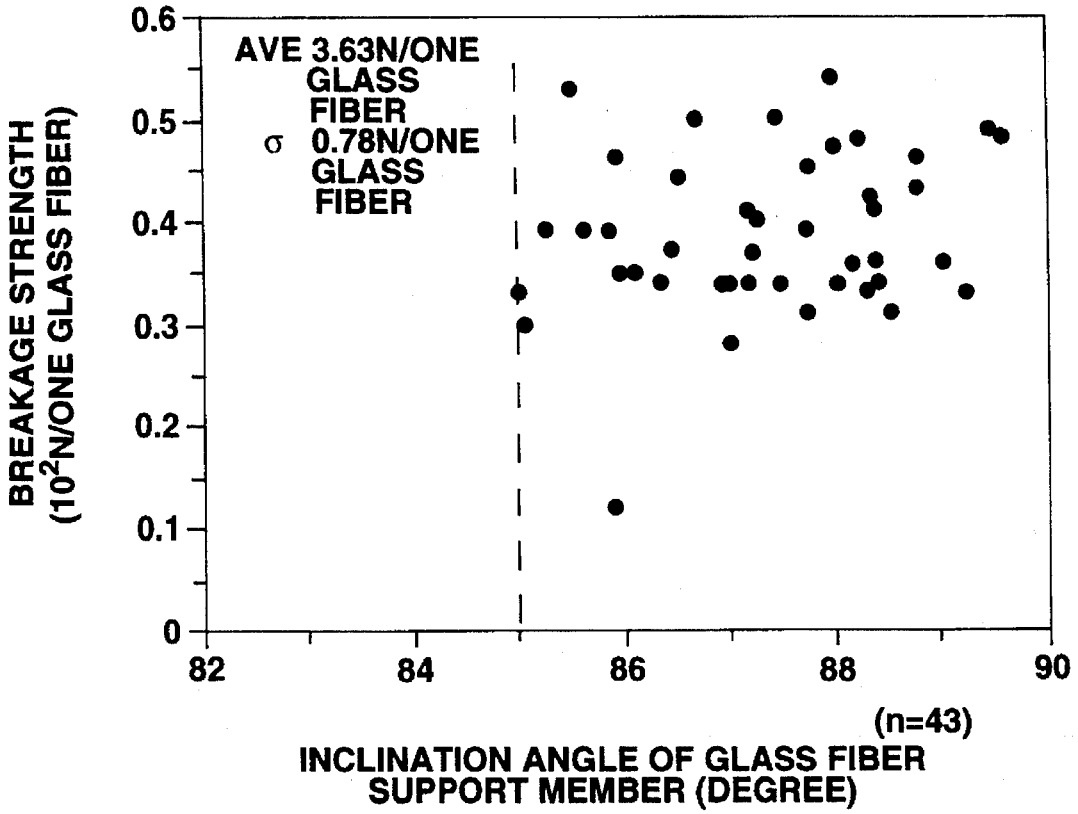
FIG. 14 is a graphical representation showing breakage strength of a support member made of a glass fiber material.

The inventors made a test on breakage strength of the support member suitable for incorporation in the FED of the present invention. The support members each were formed of a multi-component glass fiber material having a diameter of 50 μm. The result was as shown in FIG. 14, which indicates that each one support member bears 3.63N (0.37 kgf) on an average.

Also, another test was made for determining pitches of arrangement of the support members required to permit a FED of 12 cm in size of the present invention to bear a pressure of 500 kPa (5 kgf/cm$^2$). Breakage strength of each of the support members was set to be 2.06N (0.21 kgf) (AVE-2σ). A rate of formation of the support members was 80%. The glass substrate was formed into a thickness of 1.1 mm while ignoring stress. Supposing that the FED of 12 cm in size has a sealed internal area of 82.4 cm$^2$, an atmospheric pressure is 100 kPa and a pressure to be borne is 400 kPa, the number of support members required for each FED is 1962. Supposing that the support members are formed in an amount n (n: integer) times as large as pitches of picture cells, the number of support members required for every six pictures is 2120 and that for every seven pictures is 1530. Thus, the pitches of the support members were set to be 1.86 mm in the case of six picture cells. A pressurizing test revealed that each of the FED was not broken at a pressure of 500 kPa.

Further, a study was made on a size into which the support member can be formed. It was found that the process of the present invention permits formation of the support member to be carried out at an aspect ratio (ratio of diameter to length) up to 1:10. A possible diameter of the support member or a diameter into which the support member can be formed is determined depending on a diameter of holes of an alignment plate which is made of Ni and formed with holes at predetermined positions thereof by electroplating. A minimum diameter into which the hole can be formed is about 30 μm, resulting in a minimum diameter into which the support member can be formed being about 20 μm. A glass fiber which is commercially available generally has a diameter of 10 μm to 1 mm. Any glass fiber which has a diameter of 20 μm or more may be used for the process of the present invention.

The present invention is never limited to a FED. It may be applied to any image display panel which is constructed into an airtight structure formed by sealedly joining upper and lower substrates to each other by means of a sealing material.

As can be seen from the foregoing, the airtight envelope for the image display panel according to the present invention is so constructed that particulate elements such as glass beads or bar-like elements such as glass fiber elements are incorporated in a sealing material, resulting in acting as spacers for defining a required gap between the upper substrate and the lower substrate. Such a construction permits the display panel to be readily produced with high accuracy even when it is desired to form the gap into a reduced size. Also, incorporation of the particulate elements in the sealing material eliminates a step of separately arranging a spacer means.

Further, the spacers acting as the support or column members may be arranged at predetermined positions in the display area between the upper substrate and the lower substrate. Such an arrangement of the spacers permits a thickness of the airtight envelope and its weight to be significantly reduced. Further, in the present invention, the spacers acting as the support members may be formed of a material which is softened at the sealing temperature of the sealing material, to thereby prevent a variation in size of the spacers acting as the support members from deteriorating accuracy of the gap, resulting in the display panel uniformly bearing an atmospheric pressure.

Furthermore, in the image display panel of the present invention, cutting of a glass fiber material into a uniform length permits a number of the support members to be formed into a uniform dimension. This results in the gap between the anode substrate and the cathode substrate in the FED being kept constant, to thereby permit the FED to exhibit uniform luminance and satisfactory pressure resistance. Also, the method for producing the image display panel according to the present invention is constructed so as to cut a glass fiber material into a uniform length to form glass fiber bundles and position them on the substrate while securely holding them, so that the FED of the present invention which exhibits the above-described characteristics may be provided.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An airtight envelope for a display panel comprising:

an anode substrate;

a cathode substrate;

said anode substrate and cathode substrate being sealedly joined to each other by means of a sealing material comprising frit glass and elements selected from the group consisting of particulate elements and bar-like elements, to provide an airtight structure, wherein said elements have a melting temperature greater than a melting temperature of said frit glass; and spacers provided at predetermined positions in a display area defined in a gap between said anode substrate and said cathode substrate, wherein said spacers are softened at said melting temperature of the frit glass, resulting in being fixed on said anode substrate and cathode substrate.

2. The airtight envelope according to claim 1, wherein said spacers are columnar glass fibers having ends extending between the anode substrate and cathode substrate.

3. The airtight envelope as defined in claim 1, wherein said cathode substrate is provided thereon with a field emission type electron source.

4. An image display panel comprising:

an anode substrate provided thereon with a display section including phosphors;

a cathode substrate provided with a field emission type electron source on an inner surface thereof facing said display section of said anode substrate;

said anode substrate and cathode substrate being sealedly joined at an outer periphery thereof to each other by means of a sealing material so as to be spaced from each other at a predetermined interval therebetween;

support members arranged in the sealing material at positions between said anode substrate and said cathode substrate, wherein said support members each comprise a bar-like element, Said support members having a greater melting temperature than a melting temperature of said sealing material; and spacers provided at predetermined positions in a display area in a gap between said anode substrate and said cathode substrate;

wherein said spacers are columnar glass fibers having ends extending between the anode substrate and cathode substrate and are softened at said melting temperature of the sealing material.

5. A method for producing an image display panel comprising the steps of:

forming a bar-like material into support members of a predetermined length;

providing a magnetic element on one end of each of said support members;

holding said support members on a holding substrate provided at a predetermined position thereof with a magnet means;

positioning and fixing the other end of each of said support members on one of an anode substrate on which a display section is formed and a cathode substrate on which a field emission type electron source is formed;

positioning and fixing the one end of each of said support members on the other of said anode substrate and cathode substrate;

forming spacers in a gap between said anode substrate and said cathode substrate at predetermined positions in a display area, wherein said spacers are columnar glass fibers having ends extending between the anode substrate and the cathode substrate;

sealedly joining said anode substrate and cathode substrate to each other by means of a sealing material to form an airtight envelope; and evacuating said airtight envelope to a vacuum.

6. A method for producing an image display panel comprising the steps of:

sucking support members onto a positioning means provided with openings and a suction means communicating with the openings to position and hold one end of each of the support members in each of the openings;

positioning and holding, on one of an anode substrate on which a display section is formed and a cathode substrate on which a field emission type electron source is formed, the other end of each of the support members held on the positioning means;

positioning and fixing, on the other of the anode substrate and cathode substrate, the one end of each of the support members released from constraint by the positioning means;

forming spacers in a gap between said anode substrate and said cathode substrate at predetermined positions in a display area, wherein said spacers are columnar glass fibers having ends extending between the anode substrate and the cathode substrate;

sealedly joining the anode substrate and cathode substrate to each other by means of a sealing material to form an airtight envelope and evacuating the envelope to a vacuum.

* * * * *